US011351407B2

(12) United States Patent
Thoma et al.

(10) Patent No.: US 11,351,407 B2
(45) Date of Patent: Jun. 7, 2022

(54) FOAM FORMER AND FOAM SPRINKLER

(71) Applicant: EUROSPRINKLER AG, Balsthal (CH)

(72) Inventors: Markus Thoma, Riehen (CH); Jens Stubenrauch, Jena (DE)

(73) Assignee: EUROSPRINKLER AG, Balsthal (CH)

( * ) Notice: Subject to any disclaimer, the term of this patent is extended or adjusted under 35 U.S.C. 154(b) by 260 days.

(21) Appl. No.: 16/493,997

(22) PCT Filed: Mar. 12, 2018

(86) PCT No.: PCT/IB2018/051619
§ 371 (c)(1),
(2) Date: Sep. 13, 2019

(87) PCT Pub. No.: WO2018/167638
PCT Pub. Date: Sep. 20, 2018

(65) Prior Publication Data

US 2020/0023216 A1 Jan. 23, 2020

(30) Foreign Application Priority Data

Mar. 15, 2017 (CH) ..... 00315/17

(51) Int. Cl.
*A62C 31/12* (2006.01)
*B05B 7/00* (2006.01)

(52) U.S. Cl.
CPC ..... *A62C 31/12* (2013.01); *B05B 7/0062* (2013.01)

(58) Field of Classification Search
CPC .. A62C 31/12; B05B 7/26–267; B05B 7/0062
USPC ..... 169/37–41, 90; 239/428.5
See application file for complete search history.

(56) References Cited

U.S. PATENT DOCUMENTS 5,275,763 A * 1/1994 Fukai ..... A62C 5/02 169/15
5,647,539 A * 7/1997 Dobbs ..... B05B 7/0062 239/504
2007/0256844 A1* 11/2007 Blasing ..... A62C 35/68 169/37
2009/0151962 A1* 6/2009 de Ris ..... A62C 35/68 169/37
2015/0375271 A1* 12/2015 Haworth ..... B08B 3/02 239/318
2018/0064974 A1* 3/2018 Stubenrauch ..... A62C 31/12

FOREIGN PATENT DOCUMENTS

DE 19539991 C1 * 2/1997 ..... A62C 37/14
GB 724185 A * 2/1955 ..... A62C 5/002

* cited by examiner

*Primary Examiner* — Cody J Lieuwen
(74) *Attorney, Agent, or Firm* — Donald J. Ersler

(57) ABSTRACT

The invention relates to an optimized foam former (1) for foaming a foam-water concentrate, which foam former consists of a curved grate having diamond-shaped openings (13) and sharp edges (12). The structure of the foam former increases the foam formation and ensures uniform distribution of the foam over a large area. Existing water sprinklers having a nozzle (3) and a spray disk (2) can be provided with the foam former (1) and thus converted into foam sprinklers in a simple manner. The foam former (1) is arranged in such a way that the foam former (1) protrudes beyond the spray disk (2) toward the nozzle (3).

2 Claims, 7 Drawing Sheets

FOAM FORMER AND FOAM SPRINKLER

The present invention relates to a foaming head according to the preamble of patent claim 1 and to a foam sprinkler according to the preamble of patent claim 6.

Foam sprinklers are mainly used in fire fighting applications, because certain fires, especially burning liquids, can not be effectively fought with water, but only with extinguishing foam.

Extinguishing foam consists largely of filling gas (for example air), water and a foaming agent. Water and foaming agent are usually in the form of a liquid foam-water concentrate, which is distributed in the burning area via several foam sprinklers in case of fire. In order to foam the foam-water concentrate, it is known to project the liquid through a sieve. As when beating egg whites with a whisk, the impact on the sieve causes foaming by admixing air into the foam-water concentrate. The ratio between the volume of the produced foam and the volume of the original foam-water concentrate is called the "foaming ratio". Different foaming ratios may be advantageous depending on the application, and they are classified as follows:

heavy foam with a foaming ratio <20 medium foam with a foaming ratio >20 to <200 light foam with a foaming ratio >200

In order to extinguish fires of fire class B (burning liquids or liquefying substances), it is advantageous to use heavy foam with a foaming ratio between 2 and 20.

Various solutions for combining a sprinkler with a sieve to provide a foam sprinkler are presented in the prior art.

SUMMARY OF THE INVENTION

As is apparent from the patent application JP 2016182225 A, a sieve can be arranged between the mouth of the supply line of a sprinkler and the spray plate. A disadvantage of this foam sprinkler is that the foam-water concentrate is first foamed by the sieve and then the foam is distributed by the spray plate. Due to the low density of the foam, the distributing effect of the spray plate is limited, the foam being slowed down and even partially liquefied by the spray plate. Another disadvantage is that the sieve completely encloses the mouth of the supply line. Sprinklers are typically provided with a closure which is knocked out and ejected upon release. In the proposed arrangement, the closure gets caught in the sieve, thus affecting the flow and uniform distribution of the foam.

Patent DE 195 39 991 C1 discloses a foam sprinkler, wherein a sieve is arranged behind the spray plate in the flow direction of the foam-water concentrate. So, the foaming takes place mostly in the open air, after the foam-water concentrate is distributed by the spray plate. However, the foam water concentrate is already partially pre-foamed when it hits the spray plate. In this solution, there is a risk of overloading or clogging of the sieve because the foam-water concentrate and the produced foam are driven through the sieve merely by their own momentum and tend to stick to it. For this reason, a perforated plate with larger, round holes was used as a sieve, and in addition, it was arranged at a considerable distance from the spray plate. The spray plate is usually designed so that the liquid is distributed in all directions, so also back upwards. Thus, when using this conventional sprinkler, only about 60% of the foam-water concentrate distributed over the spray plate passes through the sieve and the larger, round holes improve the flow of the foam-water concentrate. However, this leads to a lower amount of foam with a lower average foaming ratio.

In order to optimize foaming in the area of the sieve, various solutions have been proposed in the patent literature. JP 2016182225 A, U.S. Pat. Nos. 5,820,027 and 5,404,957 disclose foam nozzles with two sieves arranged behind each other, the foam being able to build up through each additional sieve. Other common solutions consist in providing a conical sieve (see e.g. FR 2575082 A1, US 2013/0037282 A1, WO 2008/050973) or providing folds (see DE 100 04 916 A1). All of these existing solutions follow the same approach: In order to optimize foaming, a larger sieve area is used, either by increasing the area of a single sieve or by using multiple sieves.

However, this approach and the concrete solutions presented can hardly be implemented for foam sprinklers. One reason for this is that foaming does not take place in a pipe, but in the open air, and the foam-water concentrate cannot be driven through conical, folded or even several sieves arranged behind each other and then still be distributed with sufficient force over a large area. In addition, the total length of the foam sprinkler is ideally as small as possible, for example in order to lower the risk that the sprinkler is torn away by a forklift or by the lifted load in a storage facility.

The object of the present invention is to improve a foaming head and a foam sprinkler of the type mentioned hereinabove in order to ensure optimum foaming over a large pressure range and uniform distribution of the foam over a large area. Besides, the foaming head should be light, compact, retrofittable to existing sprinklers and inexpensive to produce.

This object is achieved by a foaming head with the features of claim 1 and by a foam sprinkler with the features of claim 6. Further features and embodiments will become apparent from the dependent claims and the advantages thereof are explained in the following description.

DETAILED DESCRIPTION OF THE PREFERRED EMBODIMENTS

Conventional water sprinklers consist of a nozzle 3 and a spray plate 2 connected to attachments 4. The spray plate 2 is arranged at a distance from the mouth of the nozzle 3 in a central position aligned with the longitudinal axis of the nozzle 3. This spray plate 2 serves to distribute a liquid flowing out of the nozzle 3 so that this liquid is distributed as homogeneously as possible around the foam sprinkler and over a large area.

Figure 1B:
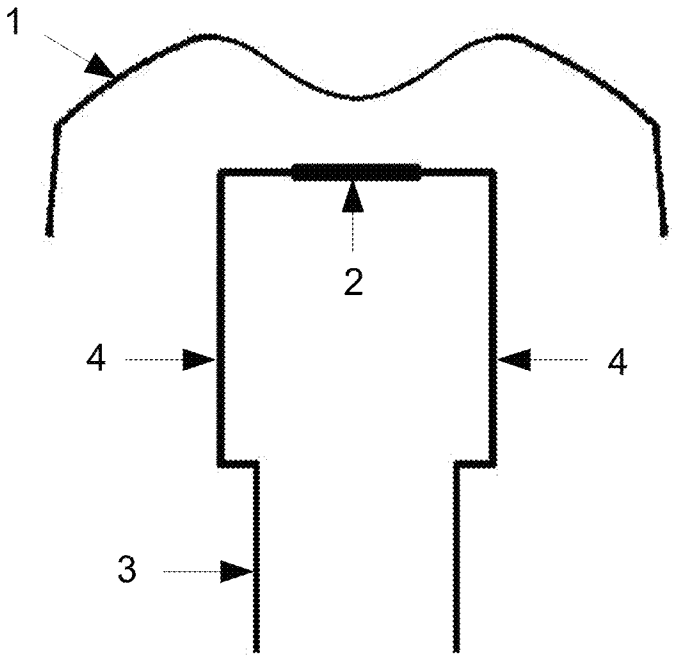
FIG. 1*a-b* Schematic arrangements of the nozzle, spray plate and foaming head, in section FIG. 2*a* Foam sprinkler in use with water and spraying pattern FIG. 2*b* Foam sprinkler in use with foam-water concentrate and spraying pattern FIG. 3*a* Webs with thickness in the flow direction smaller than the width perpendicular to the flow direction FIG. 3*b* Webs with thickness in the flow direction larger than the width perpendicular to the flow direction FIG. 4*a* Detail of a rhombic opening FIG. 4*b* Embodiment of the foaming head, top view FIG. 5*a-d* Exemplary connection of the foaming head to the sprinkler nozzle, in section FIG. 6*a* Embodiment of the foaming head with threaded rod, in section FIG. 6*b* Embodiment of the sprinkler with foaming head and threaded rod FIG. 7*a* Embodiment of the foaming head with split escutcheon, in section FIG. 7*b* Embodiment of the sprinkler with foaming head and split escutcheon, in section The figures represent possible embodiments which will be explained in the following description.
Figure 1A:
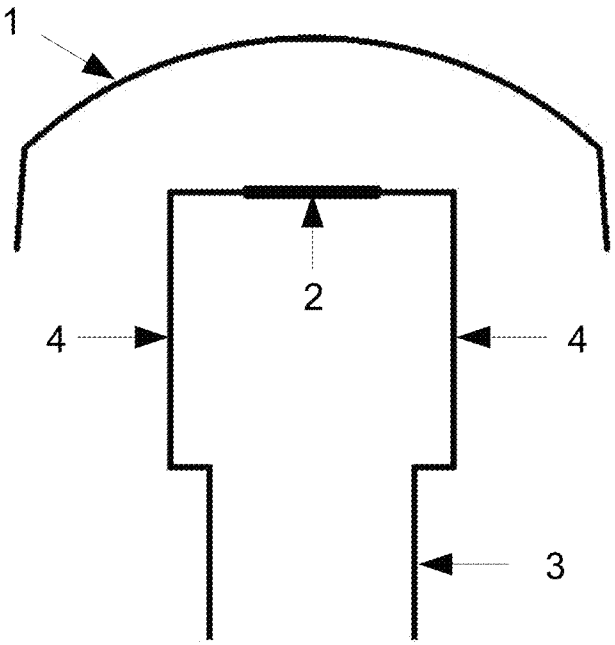

In order to build a foam sprinkler, existing water sprinklers can be provided with the foaming head 1 according to the invention (FIG. 1*a*). The foaming head 1 is arranged behind the spray plate 2 in the flow direction of the foam-water concentrate, so that the foam-water concentrate is first accelerated, pre-foamed and distributed by the spray plate 2, and then foamed by the foaming head 1. Advantageously, the foaming head 1 has a shape curved in the direction of the nozzle 3 and is arranged such that the foaming head 1 projects beyond the spray plate 2 in the direction of the nozzle 3, the spray plate 2 thus being located "in the foaming head" 1. A further possible embodiment, wherein the foaming head 1 has a depression in the middle, is shown in FIG. 1*b*. Since the entire foam-water concentrate is projected through the foaming head 1 regardless of the direction in which it is distributed by the spray plate 2, a maximum amount of foam is created with a bubble size as uniform as possible. This construction with the spray plate 2 in the foaming head 1 also has the advantage that it is considerably more compact than the existing devices, since the total length of the sprinkler is only slightly affected by the additional foaming head 1.

For applications in which no sprinkler is needed, for example when the extinguishing system is activated centrally via a fire alarm, the foaming head 1 can of course also be mounted directly in front of a nozzle 3. This nozzle 3 can also be additionally equipped with a spray plate 2 to adjust the spraying pattern to the desired application.

Upon activation of the sprinkler, the closure of the nozzle 3 is usually tilted sideways and ejected by a spring. To prevent this closure from getting caught in the foaming head 1, a sufficient distance between the edges of the foaming head 1 and the mouth of the nozzle 3 must be maintained. It is important to avoid the closure getting caught in the foaming head 1 as this would interfere with the flow and uniform distribution of the foam.

Figure 4A:
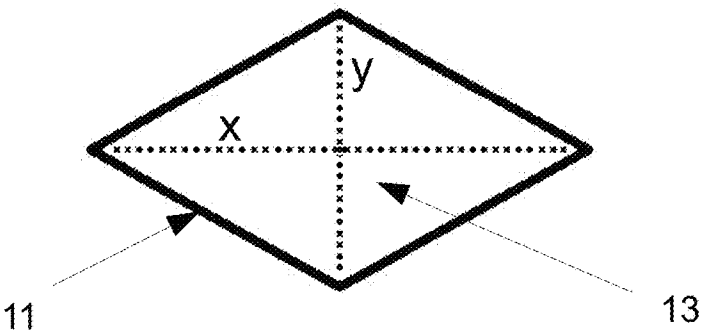
Figure 4B:
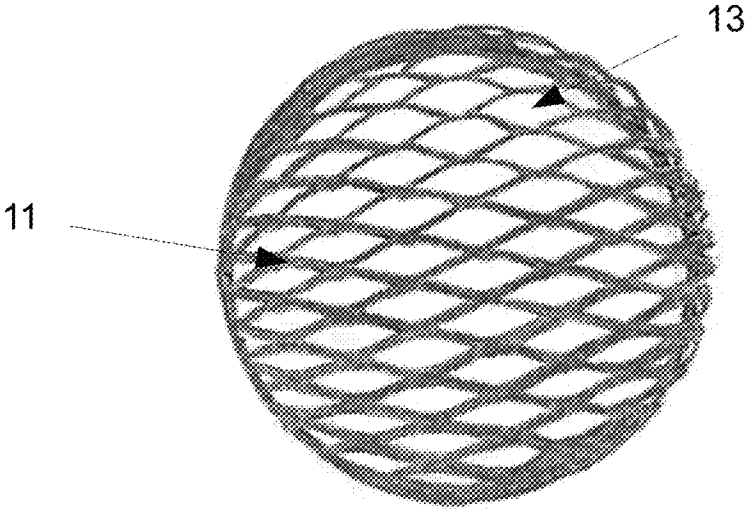

The foaming head 1 consists of a grid with webs 11 and openings 13 (see FIG. 4*b*). For use with a sprinkler, it is specified to make the grid of metal, such as stainless steel, brass, aluminum or any other metal or metal alloy. For other applications in lower temperature ranges, the grid may also be made of plastic or other sufficiently robust materials.

According to the invention, the foaming head 1 must fulfill two essential criteria. First, it should interfere with the flow of foam-water concentrate or foam as little as possible, so that the foam maintains a high speed and the spraying pattern is not affected. Second, the foaming head 1 should ensure the best and most uniform foaming regardless of the operating pressure.

In order to achieve a good flow, the openings 13 of the foaming head 1 must have a sufficient size. For the present invention, a minimal diameter of more than 1 mm, preferably more than 4 mm is intended. Such sizes avoid any risk of overloading or clogging the foaming head 1, even and especially for particularly high flow rates. Foam sprinklers with a K-factor between K20 to K160 and even K200 could be provided.

So, with the presented foam sprinklers, particularly high flow rates of extinguishing agent can be achieved at constant pressure. Existing foam sprinklers available on the market currently have a maximal K factor of K115. Due to the higher performance of the foam sprinklers according to the invention, a better and faster extinguishing effect can be achieved.

Figure 2A:
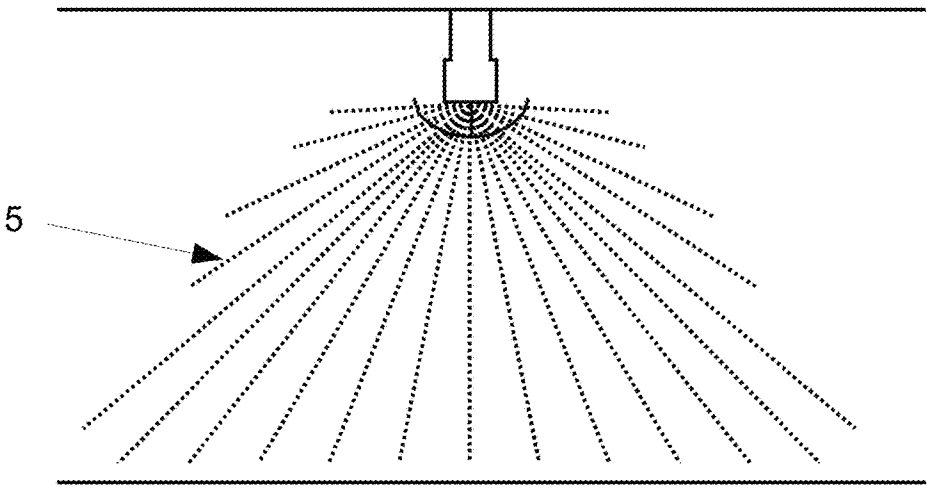
Figure 2B:
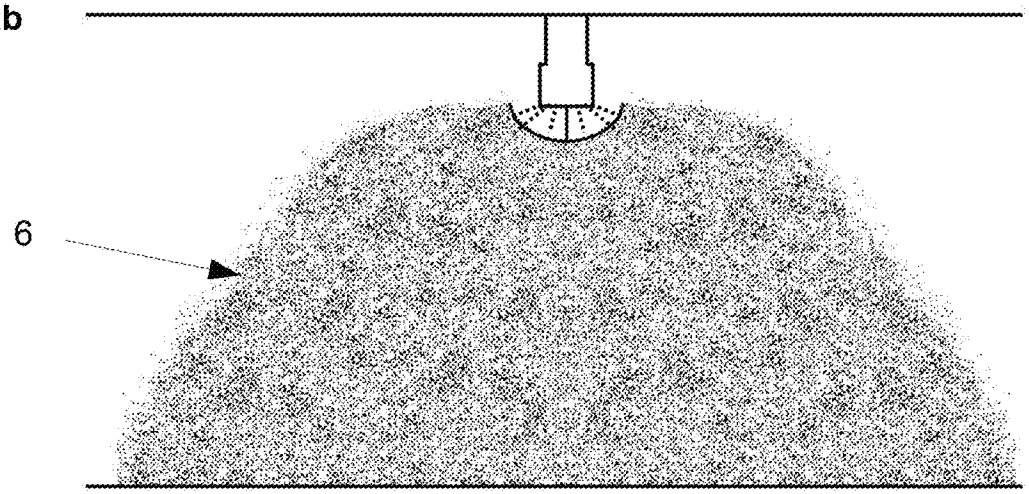

Since the presented foaming head 1 neither affects nor impairs the spraying pattern of the sprinkler, both foam-water concentrate for producing foam 6 and pure water 5 can be sprinkled with the same sprinkler (FIGS. 2*a-b*). This has for example advantages for warehouses, in which a conversion takes place, or even in which different materials are stored alternately, so that the sprinkler system can sometimes be operated with extinguishing foam and sometimes with water depending on the stored material. Since the spraying pattern does not change even when retrofitting with a foaming head according to the invention, this also has the advantage that all calculations that have already been made continue to be valid and applicable. This may be important if an existing sprinkler system previously used with fluorine extinguishing agent for better foam distribution is now re-used with a foaming head to allow the use of a fluorine-free extinguishing agent.

In order to achieve the best foaming, the foaming head 1 is preferably used with the following properties.

Foaming takes place by admixing air into the foam-water concentrate. In order to boost this admixture, it is advantageous to produce turbulences in the foam-water concentrate in the region of the foaming head 1 and to increase the contact area between the foam-water concentrate and the air.

Figure 3A:
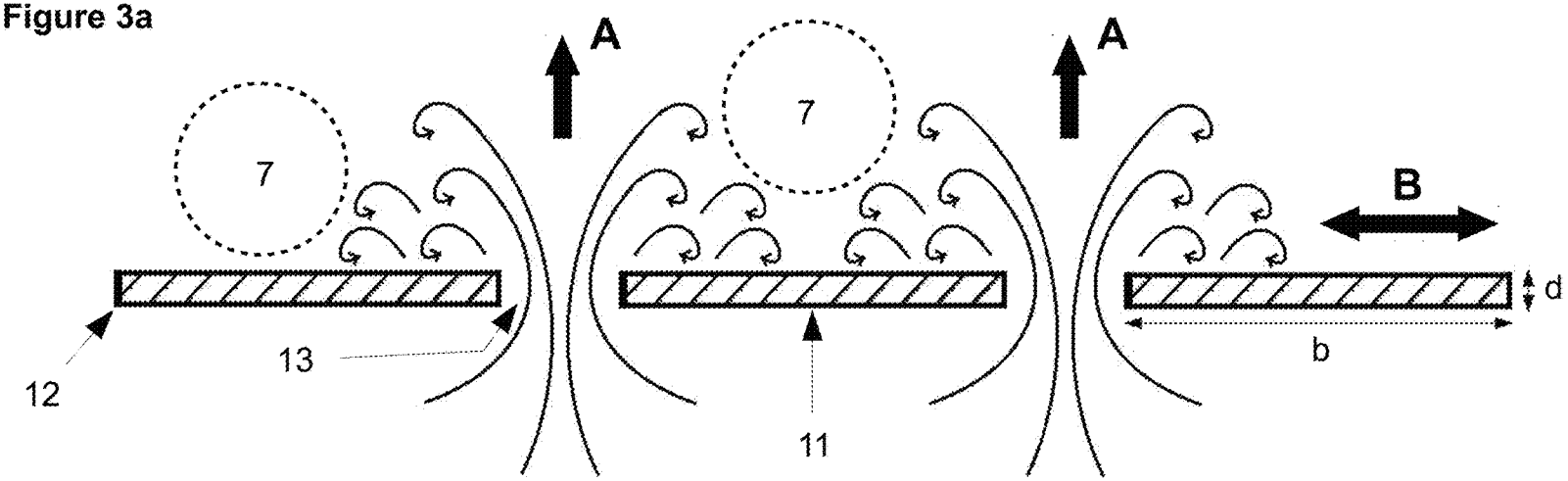
Figure 3B:
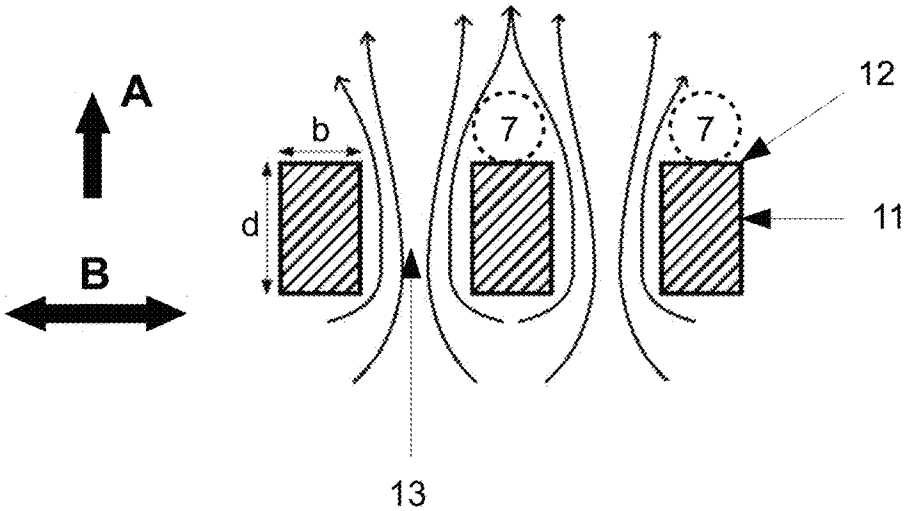

In order to generate a turbulent flow of the foam-water concentrate, the webs 11 of the grid have an elongated section whose longitudinal direction B is approximately perpendicular to the flow direction A (FIG. 3*a*). It is particularly advantageous if the ratio b/d width/thickness of the webs 11 is greater than 1, preferably greater than 1.4 (FIG. 3*a*). This avoids the emergence of a laminar flow in the region of the openings 13 and allows the formation of turbulence behind the webs 11 between two adjacent openings 13. If the webs 11 are wider than 1 mm, preferably wider than 1.5 mm, air is located in the area 7 behind the webs 11, which is admixed to the foam-water concentrate by the effect of the turbulences and boosts the foaming. Webs 11 having a large thickness d in the flow direction A and a small width b perpendicular to the flow direction B are inadequate for the formation of turbulences, since only little air is present in the region 7 behind the webs 11 and the streams can come together behind the openings 13 without great turbulence (FIG. 3*b*). In order to further promote the formation of turbulences, the webs 11 according to the invention preferably have sharp, angular edges 12. Sharp, angular edges 12 cause a strong deflection of the liquid from the webs 11 and promote the emergence of turbulences and thus the formation of foam.

When flowing through the foaming head 1, the stream of foam-water concentrate is divided by the webs 11 into many smaller, separate streams. The contact area between the foam-water concentrate and the air can thus be influenced by the number of webs 11 on the grid. To increase the number of webs 11 on the grid, the shape of the openings 13 has been optimized in such manner that the grid has a higher total edge length while retaining the same total area. According to the invention, the grid has rhombic openings 13, with diagonals x and y (FIGS. 4*a-b*). Simple calculations show that in rhombic openings 13, the ratio circumference/area of the opening 13 is significantly greater than in round, square or rectangular openings. For the optimal operation of the foaming head 1, the ratio of the length of the diagonals x/y of the rhombic openings 13 is crucial. If the ratio is too small, for example with x/y=1, the openings are square, which reduces the edge length. With too large ratios, for example, with x/y>5, the diagonal b is too short and the opening 13 is too narrow, which affects the flow of the foam water concentrate or the foam. Experiments have shown that optimal ratios x/y are between 1.5 and 4, preferably between 2 and 3. In the present description, the term "rhombic" also means the shape of a parallelogram, i.e. a quadrangle which does not necessarily have 4 equal-sized sides.

A possible, particularly effective embodiment of the foaming head has a grid with the following dimensions: width b of the webs 11 about 1.0-1.5 mm, thickness d of the webs 11 about 0.5-1.0 mm, length x of the openings 13 about 1.0-1.5 cm and width y of the openings 13 about 3.0-7.0 mm, with b/d=1.5 and x/y=2.4.

This type of grid can be produced by various methods, for example by punching and subsequent bending of a metal sheet, by sintering or by any other conventional production method. The use of a commercially available expanded metal mesh or expanded metal sheet has proved to be particularly efficient. The openings 13 of expanded metal meshes are made without loss of material, and sharp edges 12 are also formed. In addition, expanded metal meshes are commercially available in many dimensions and materials and therefore inexpensive. When bending a flat expanded metal mesh or sheet for forming the foaming head 1 as shown in FIGS. 1*a-f* and 4*b*, the shape and dimensions of some openings 13 may slightly deviate from the ideal value, especially around the edges of the foaming head 1, where the curvature is the strongest. However, it has been shown that this does not affect the operation of the foaming head 1.

Due to the optimized shape of the openings 13 and to the specific section of the webs 11 in the grid, a foaming head 1 is provided, which ensures strong foaming despite large openings 13. Experiments have shown that with such a foaming head 1, foaming ratios between 4 and 20 can be achieved. The flow of foam water-concentrate is neither affected nor impaired by the large openings 13, so that the foam is distributed uniformly in the environment and the foaming head 1 is not overloaded even at high flow rates. It has also been shown that the foaming works very well over a wide range of pressures and flow rates with the presented foaming head 1. Pressure ranges of 0.5 to 15 bar and flow rates between 10 and 1000 liters per minute were tested. Flow rates of up to 10000 liters per minute are also possible. This is particularly advantageous for fire-fighting foam sprinklers: depending on the application, when a fire breaks out, only the foam sprinklers located in vicinity of the fire are activated. The pressure in the sprinkler supply lines is therefore very high, as is the flow rate in the activated foam sprinklers. As the fire spreads, more and more foam sprinklers are activated so that the pressure in the supply lines and the flow rate per foam sprinkler decrease. With the foaming head 1 according to the invention, the spraying pattern is kept constant even with large variations of these values, so that an optimal extinguishing effect is achieved.

Figure 5A:
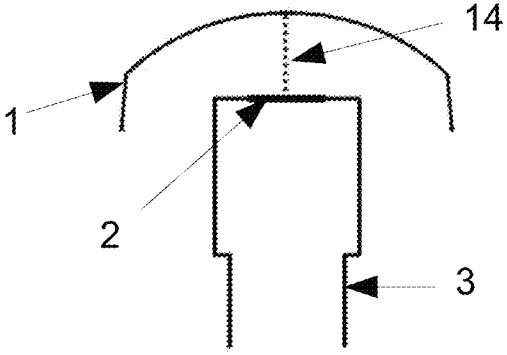
Figure 5B:
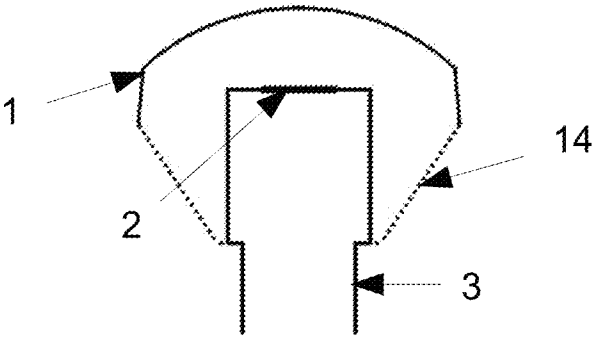
Figure 5C:
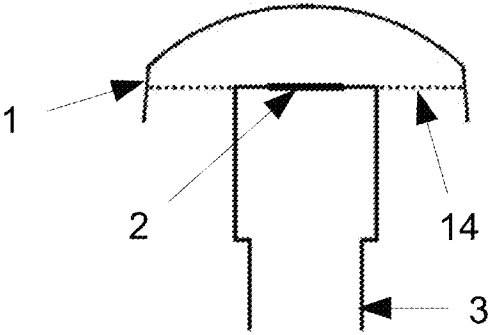
Figure 5D:
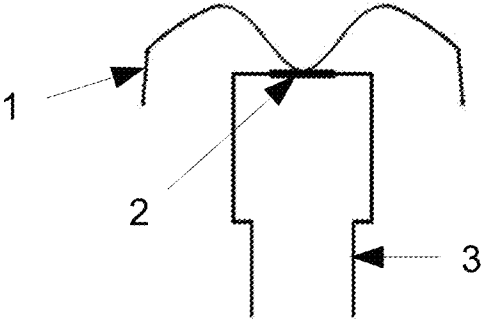

The foaming head 1 according to the invention is also perfectly suited for retrofitting to an existing sprinkler. FIGS. 5*a* to 5*c* show how the foaming head 1 can be connected by means of adapters 14 with the sprinkler. The adapter 14 is used for correct positioning and attachment of the foaming head 1 on the sprinkler in a very short time. Of importance for the geometry of the adapter 14 is that the spraying pattern is not affected when retrofitting the foaming head 1 onto an existing sprinkler, i.e. the connections between the foaming head and the sprinkler should be arranged in an already existing spraying shadow if possible. If the foaming head 1 has a depression in the middle, the depth of this depression can be set such that the foaming head 1 can be fastened directly onto the spray plate 2 without adapter 14 (FIG. 5*d*).

Figure 6B:
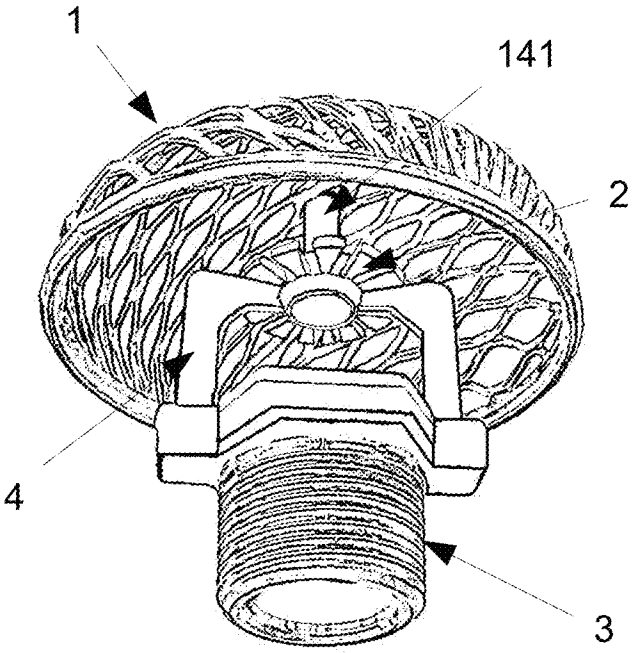
Figure 6A:
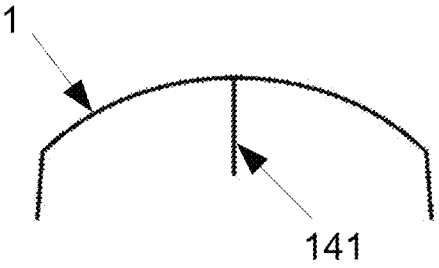

In the preferred embodiment, the adapter 14 consists of an elongated threaded rod 141, which is arranged in the middle of foaming head 1 (FIG. 6*a*). For example, the threaded rod 14 protrudes on the inner side through the central opening of the grid and has a nut to which the foaming head 1 is attached on the outer side. The middle of the spray plate 2 of the sprinkler is provided with a thread on which the threaded rod 141 can be screwed. In the assembled state, the threaded rod 141 is arranged in the flow direction behind the spray plate 2 (FIG. 5*a*). FIG. 6*b* shows an embodiment of the invention in the mounted state.

Figure 7B:
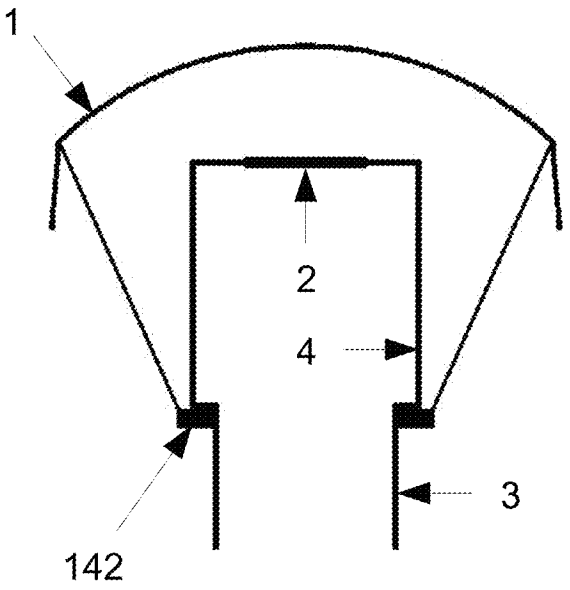
Figure 7A:
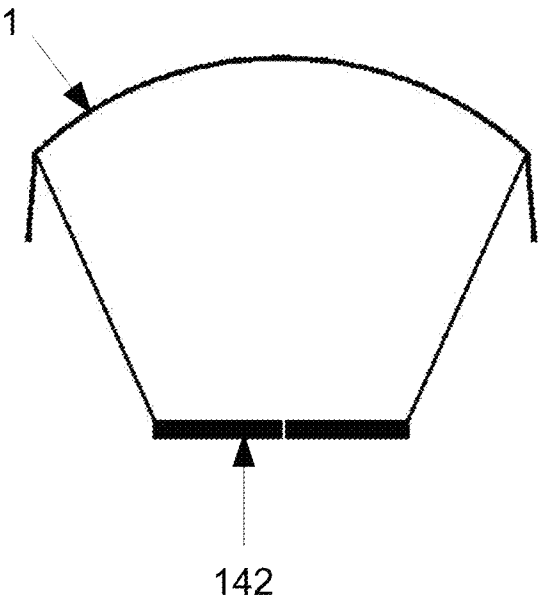

In another possible embodiment, the adapter 14 has a split escutcheon 142 (FIG. 7*a*), which is attached at the recess below the nut with which the sprinkler was screwed to the pipe (FIG. 7*b*). This split escutcheon allows the foaming head to be properly positioned, easily attached and retrofitted in a very short time.

Another possible variant is the attachment of the foaming head to the connecting pieces with which the spray plate is attached to the sprinkler (FIG. 5*c*). This could be done, for example, by clamps or other suitable means.

The invention claimed is:

1. Foam sprinkler with a nozzle (3), a substantially planar spray plate (2) and a foaming head (1) for foaming a foam-water concentrate, said foaming head (1) having a dome shape and including a grid with webs (11) and openings (13), wherein the openings (13) are rhombic and the edges (12) of the webs (11) are angular, wherein the spray plate (2) is located between the nozzle (3) and the foaming head (1), characterized in that the foaming head projects beyond the spray plate (2) towards the nozzle (3), so that the spray plate (2) is located inside an interspace of the foaming head (1), the spray plate (2) has an outer perimeter which is less than an outer perimeter of the foaming head (1); and said dome shape includes an apex, a first distance exists between said spray plate (2) and said apex in one direction, a second distance exists from said spray plate to an end of said foam head (1) in an opposite direction characterized in that a mouth of the nozzle (3) is located at the exit of the nozzle (3) towards the spray plate (2), a closure at the mouth of the nozzle which is ejected laterally when the foam sprinkler is activated, and in that an outer circumference of the foaming head (1) is located at a distance from the mouth of the nozzle (3), wherein said distance corresponds to the maximum dimension of the closure, so that the closure is ejected laterally between the mouth of the nozzle (3) and the edge of the foaming head (1) and does not get caught in the foaming head (1) upon activation of the foam sprinkler.

2. The foam sprinkler according to claim 1, wherein:

a radial gap exists between an outer perimeter of said spray plate (2) and an inner perimeter of said foaming head (1).

* * * * *